US005940675A

United States Patent [19]

Balliett et al.

[11] Patent Number: 5,940,675

[45] Date of Patent: Aug. 17, 1999

[54] T222 PRODUCTION BY POWDER METALLURGY

[75] Inventors: Robert W. Balliett, Westborough; Trung Luong, Worcester, both of Mass.

[73] Assignee: H. C. Starck, Inc., Newton, Mass.

[21] Appl. No.: 08/998,101

[22] Filed: Dec. 24, 1997

[51] Int. Cl.[6] ..... B22F 3/00

[52] U.S. Cl. ..... 419/54; 419/55; 419/26; 419/28; 419/29

[58] Field of Search ..... 419/26, 28, 29, 419/54, 55; 75/245; 420/427

[56] References Cited

U.S. PATENT DOCUMENTS

| | | | |
|---|---|---|---|
| 3,166,414 | 1/1965 | France et al. | 420/427 |
| 3,183,085 | 5/1965 | France et al. | 420/427 |
| 3,243,290 | 3/1966 | Clark et al. | 420/427 |
| 3,390,983 | 7/1968 | Ammon et al. | 420/427 |
| 3,498,854 | 3/1970 | Buckman | 420/427 |

*Primary Examiner*—Ngoclan Mai
*Attorney, Agent, or Firm*—Perkins, Smith & Cohen, LLP

[57] ABSTRACT

Powder metallurgy production of T222 alloy affording properties comparable to melt derived T222, but at higher yields and lower costs, is enabled by blending component powders of minus 325 mesh and sintering at 2,400° C. in three sinter steps and utilizing a slow ramp up in the first sinter step and cold isostatic pressing prior to the first sinter step and isostatic press densification in conjunction with at least the first sinter step.

3 Claims, 2 Drawing Sheets

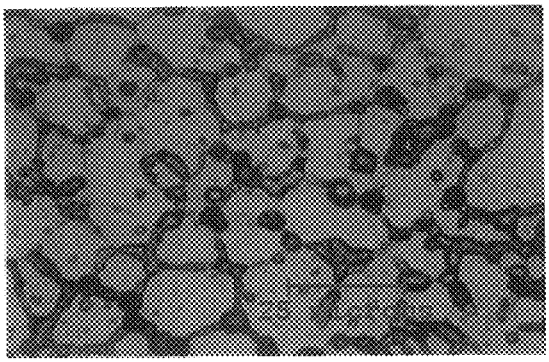
T222 ANNEALED FIG. 1
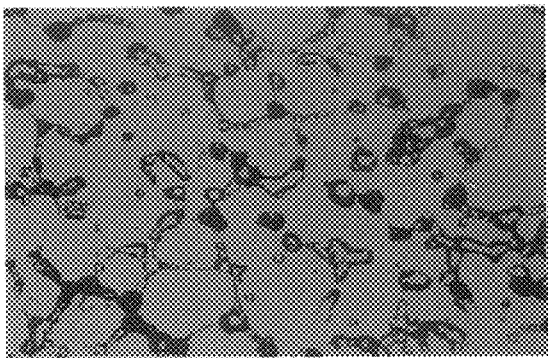
BINARY IMAGE FIG. 3
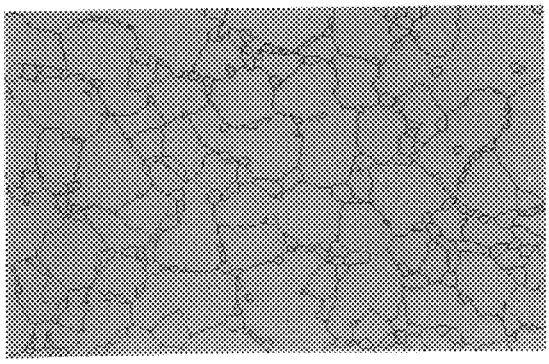
BOUNDARIES & PRECIPITATES
FIG. 2
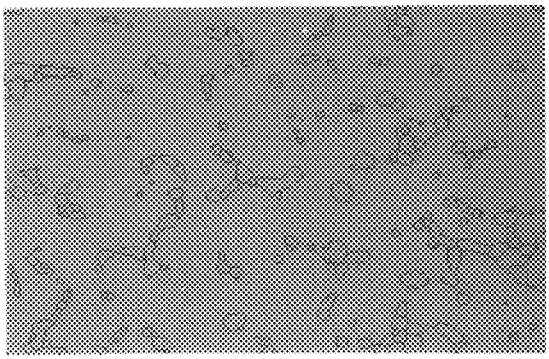
PRECIPATES
FIG. 4

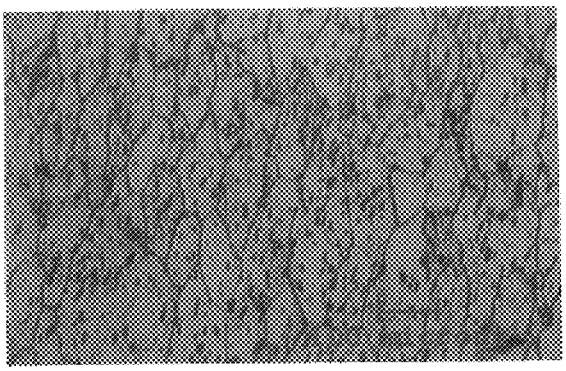
T222 UNANNEALED FIG. 5
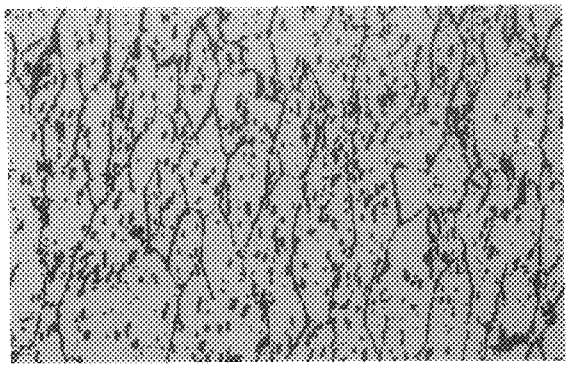
BINARY IMAGE FIG. 7
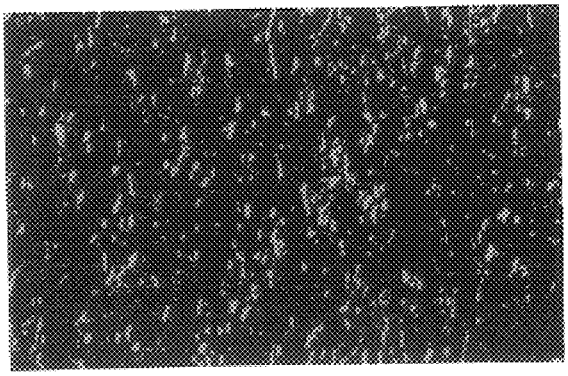
PRECIPITATES
FIG. 6
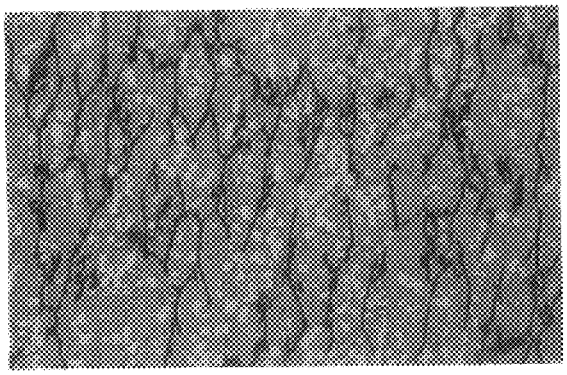
PRECIPITATES ON ORIGINAL
FIG. 8

T222 PRODUCTION BY POWDER METALLURGY

BACKGROUND OF THE INVENTION

The present invention relates to production of T222 alloy. Developed in 1960, this tantalum base alloy provides corrosion resistance and high strength at elevated temperatures and has been used to make tubes and other mill products and fabricated parts contacting liquid metal in coolant systems. T222 comprises 9–10 w/o tungsten, 2.5–2.75 w/o hafnium, balance tantalum. It is preferred in some applications to add 0.1 w/o carbon to form hafnium carbides for added dispersion strengthening. The alloy can also be treated to create hafnium oxide for dispersion strengthening.

State of the art processes for making T222 involve complex melt cycles, including e.g. the Bechtel-Nevada process with two electron beam melts to alloy Ta, W followed by two vacuum arc melts (for alloying with hafnium) to produce ingots that can be broken down subsequently by extrusion and hot forging. The resultant material can thereafter be cold worked to produce wire, sheet and other forms.

It is the object of the invention to provide a T222 alloy product and process of making it characterized by higher yields and lower cost while substantially matching properties of the state of the art products.

SUMMARY OF THE INVENTION

The objects are achieved by a powder metallurgy process using very fine Ta, W, Hf powders and a long sinter cycle, preferrably at least 10 hours at over 2,100° C. It has been found that through this process, surprisingly, powder metallurgy can be successfully implemented to produce a T222 alloy which not only eliminates the costly melt, primary hotworking extrusion and hot rolling steps, eliminates the cost of disposable molybdenum can scrap but also affords a higher yield.

Other objects, features and advantages will be apparent from the following detailed description of preferred embodiments taken in conjunction with the accompanying drawings in which:

BRIEF DESCRIPTION OF THE DRAWING

FIGS. 1–8 are photomicrographs of the alloy at various stages of processing explained below.

DETAILED DESCRIPTION OF PREFERRED EMBODIMENTS

The powder metallurgy T222 alloy produced pursuant to the present invention has a fine grain structure despite the extended sinter time, is uniformly alloyed and stress free. The extrusion and forging breakdown steps are not needed. The product as produced by the present process can be cold worked.

Practice of the invention is illustrated by the following non-limiting examples:

EXAMPLE 1

A powder was made up of:

43.75 weight % −325 mesh J powder
43.75 weight % −325 mesh RC powder
10 weight % W powder
2.5 weight % Hf powder where J tantalum powder is a sodium reduced powder and RC powder is an electron beam melted hydride/dehydride tantalum powder. The mixture produces a bimodal particle size distribution which produces an open structure when isostatically pressed that aids in the purification process in the course of sintering. All % figures are by weight. The powders were rough mixed and then blended for homogeneous distribution in a V-blender for 15 minutes, cold isostatically pressed (without binder) at 50 ksi and then sintered into two 0.9 in.×0.9 in. bars in three steps as follows:

First Sinter 1 hour at 1,800° C.
1 hour at 1,900° C.
1 hour at 2,000° C.
3 hours at 2,400° C., followed by isostatic density pressing at 90 ksi Second Sinter 3½ hours at 2,400° C., followed by isostatic density pressing at 90 ksi Third Sinter 5 hours at 2,400° C., without pressing The bars were rolled to 0.082 in. diameter wire in the following schedule:

a. Roll to 0.620" (53% reduction in area)
b. Anneal at 2,500° F. for about 15 minutes
c. Roll to 420" (59% RA)
d. Anneal at 2.500° F. for about 15 minutes
e. Roll to 0.270" (59% RA)
f. Anneal at 2,500° F. for about 15 minutes
g. Roll to 0.147" (70% RA)
h. Anneal at 2.500° F. for about 15 minutes
i. Roll to 0.082" (76% RA)
j. Final anneal T222 at 2,800° F.

After each rolling step cracked corners, ends or surface portions were removed. The overall yield was 50%, highly favorable compared to melt derived products. Most yield loss was due to corner cracking in the first yield sequence.

Chemical and Physical Properties

The standard T222 oxygen ppm specifications for melt produced (Bechtel process) is 180 ppm, tested at final sheet form. In contrast, final sheets of T222 produced as described above had 26–99 ppm oxygen content. Similarly the product of the invention had 15–27 ppm nitrogen content in contrast to a melt derived T222 specification (in final sheet form) of 50 ppm. Carbon content also appears to be lower through the present invention.

Grain size of ASTM 8.5–10 was realized for the present invention compared to ASTM 6 for melt derived T222. Room temperature and high temperature yield strength and ultimate tensile strength for the powder derived product were less than for melt product, but elongation at room and elevated temperature was higher for the powder metallurgy product all as shown in the following table:

TABLE 1

| Chemical Composition (ppm, except where shown as %) | | | | | |
|---|---|---|---|---|---|
| Sample | O | N | C | W (%) | Hf (%) |
| T222 #1[1] | 135 | <5 | <5 | 10.30 | 1.76 |
| T222 #2a[2] | 26 | 15 | — | 9.96 | 2.28 |
| 2b | 73 | 27 | — | 9.99 | 2.27 |
| 2c | 48 | 17 | — | 10.00 | 2.33 |
| 2d | 39 | 15 | — | 9.96 | 2.30 |
| 2e | 42 | 14 | — | 9.89 | 2.36 |
| 2f | 41 | 15 | — | 9.88 | 2.29 |
| 2g | 149 | 9 | 34 | — | |
| T222 #3 | 150 | 7 | — | — | |
| Specification[3] | 180 | 50 | 180 | 9–11 | 2.25–2.75 |

TABLE 2

| Mechanical Properties | | | | | |
|---|---|---|---|---|---|
| | Sample | | | | Specification |
| | T222-1 | T222-2T[4] | T222-2L[5] | T222-3 | |
| Density (AS sintered)(9/cc) | 16.02 | 16.15 | 16.15 | 16.08 | — |
| hardness (Bhn) | 120.5 | 122.5 | 122.5 | 120.9 | — |
| RT-UTS (ksi) | 108.1 | 105.9 | 101.6 | 113.2 | 110–130 |
| RT-yield str. (ksi) | 90.6 | 93.2 | 86.8 | 90.0 | 105–125 |
| RT-elongation (%) | 25 | 23 | 26 | 25 | 20 |
| Grain size (ASTM#) | 10. | 8.5 | 8.5 | — | 6 |
| 2,000 F-UTS | 56 | 68 | 82.8 | — | 70–90 |
| 2,000 yield str. | 34 | 30.3 | 31.5 | — | 40–50 |
| 2,000 elongation | 5 | 20.9 | 11 | — | 15 |

[1]Items T222-2a, 2g and 3 are bar ends. #1 was pressed and sintered with density pressing during sintering; #s2, 3 sintered without such density pressing.
[2]Items 2a–2f and the Bechtel standards are final sheets.
[3]Standard specification published by Bechtel Corp.
[4]Transverse tensile measurement.
[5]Longitudinal tensile measurement. 2000° F. UTS yield and elongation are under-represented due to a test fixture problem.

FIGS. 1–8 show scanning electromicrgraphs (SEMS) in analog and binary image forms for a T222 alloy processed as described herein. Note the 25 and 100 micron fiduciary markings in FIGS. 1 and 5 and annealed (FIGS. 1–4) and unannealed (FIGS. 5–8) conditions.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. Process for production of T222 alloy comprising:

(a) providing fine (minus 325 mesh) form of component Ta, W, Hf component powders of the alloy in standard T222 percentages;

(b) sintering the powders to a dense compact in a series of sintering steps, each comprising at least 3 hours at 2,200° C. or higher.

2. Process in accordance with claim 1 wherein the sintering steps are preceded by cold isostatic pressing and at least a first of the steps comprises isostatic pressing densification.

3. Process in accordance with either of claims 1 or 2 wherein the sintering steps are used as follows:

First Sinter 1 hour at 1,800° C.

1 hour at 1,900° C.

1 hour at 2,000° C.

3 hours at 2,400° C., followed by isostatic density pressing at 90 ksi

Second Sinter

3½ hours at 2,400° C., followed by isostatic density pressing at 90 ksi

Third Sinter 5 hours at 2,400° C., without pressing and the first sinter step is preceded by cold isostatic pressing at 50 ksi.

* * * * *